US005239930A

United States Patent [19]

Adam et al.

[11] Patent Number: 5,239,930

[45] Date of Patent: Aug. 31, 1993

[54] HYPERVELOCITY SABOT

[75] Inventors: Charles R. Adam, Gillingham; Andrew V. B. Bowden, Sevenoaks; Graeme D. Metcher, London; Allan J. Richards, Dartford, all of England

[73] Assignee: The Secretary of State for Defence in Her Britannic Majesty's Government of the United Kingdom of Great Britain and Northern Ireland, London, England

[21] Appl. No.: 934,629

[22] PCT Filed: Feb. 6, 1991

[86] PCT No.: PCT/GB91/00186

§ 371 Date: Sep. 16, 1992

§ 102(e) Date: Sep. 16, 1992

[87] PCT Pub. No.: WO91/12484

PCT Pub. Date: Aug. 22, 1991

[30] Foreign Application Priority Data

Feb. 8, 1990 [GB] United Kingdom ..... 9002829

[51] Int. Cl.[5] ..... F42B 14/06

[52] U.S. Cl. ..... 102/522; 89/7

[58] Field of Search ..... 102/506, 520–523; 89/7, 14.6

[56] References Cited

U.S. PATENT DOCUMENTS

| | | | |
|---|---|---|---|
| 3,148,472 | 9/1964 | Hegge et al. | 102/521 |
| 3,430,572 | 3/1969 | Hebert et al. | 102/521 |
| 3,476,048 | 11/1969 | Barr et al. | 102/521 |
| 3,496,869 | 2/1970 | Engel | 102/522 |
| 3,598,057 | 8/1971 | Potter | 102/506 |
| 4,000,698 | 1/1977 | Corney | 102/522 |
| 4,996,923 | 3/1991 | Theising | 102/438 |

FOREIGN PATENT DOCUMENTS

| | | |
|---|---|---|
| 2644154 | 9/1982 | Fed. Rep. of Germany . |
| WO87/05386 | 9/1987 | PCT Int'l Appl. . |

*Primary Examiner*—Harold J. Tudor

*Attorney, Agent, or Firm*—Nixon & Vanderhye

[57] ABSTRACT

A sabot for launching a sub-caliber projectile (7) comprising a rearwardly positioned projectile pusher member (1) and a forward support structure (2), the support structure comprises frangible material which is collapsible by virtue of acceleration forces experienced during acceleration of the sabot. The support structure is preferably made of foamed plastics material and has a cover positionable to retain the projectile in the support structure. Such a sabot is particularly suitable for launching small projectiles during high velocity impact investigation. The invention also provides a method of launching a projectile using the sabot.

17 Claims, 3 Drawing Sheets

HYPERVELOCITY SABOT

Figure 1:
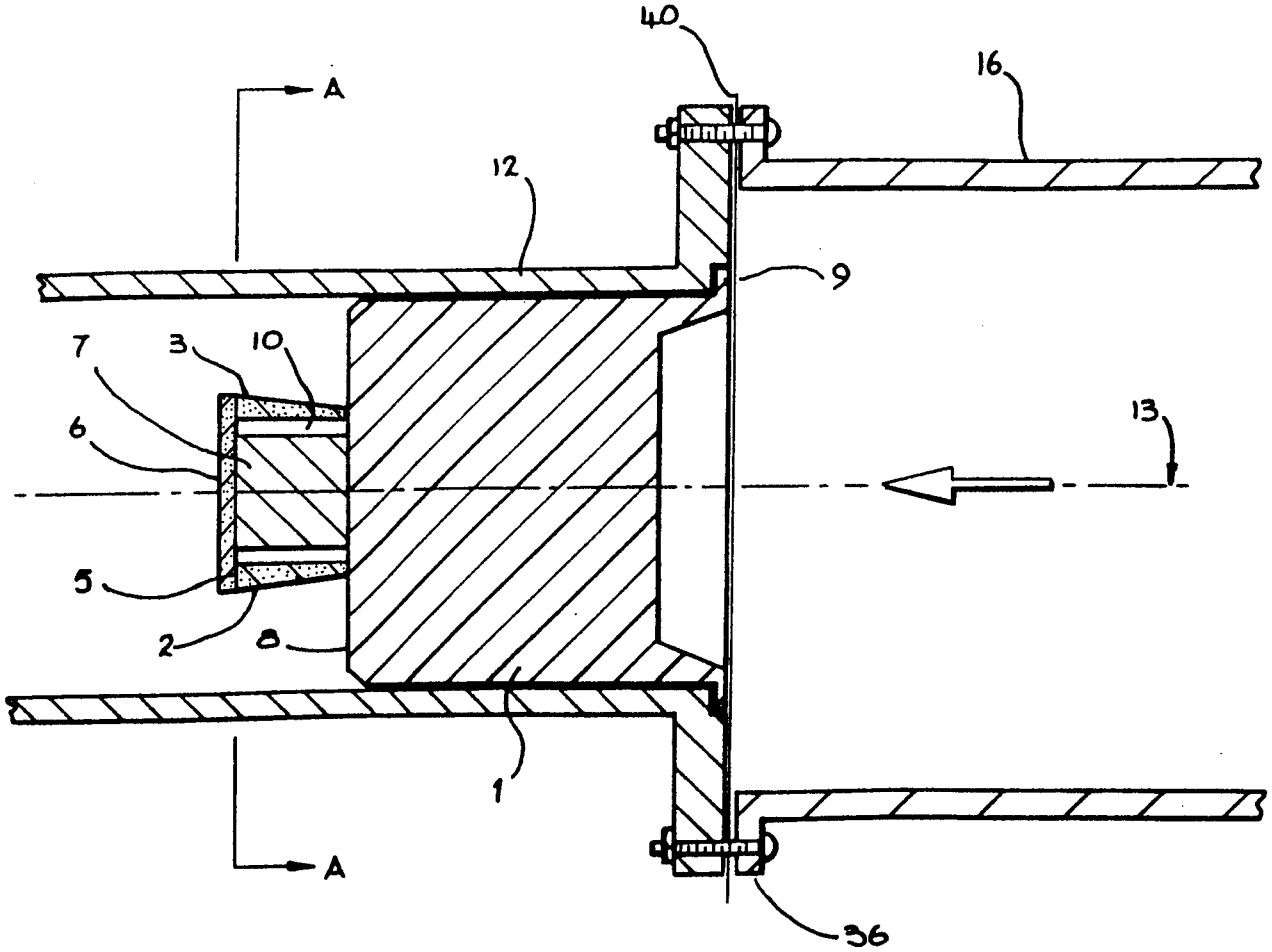

This invention relates to the field of sabots suitable for launching sub-calibre projectiles at very high velocities at targets.

There is a need to investigate how projectiles with velocities in excess of 3500 m/s interact with targets. When the projectiles concerned are smaller than the barrel from which they are being launched they are supported in the barrel by a sabot which acts to transfer the force of propelling gas to the projectile, and which is discarded shortly after leaving the barrel. A particular problem arises however when the projectiles concerned are very small, and are deviated in an unpredictable manner as the sabot is discarded making it impossible to launch such small projectiles with a sufficient degree of accuracy.

The type of gun normally used in high velocity impact investigations is a two stage light gas gun which accelerates a projectile in a barrel with compressed low density gas. In order to reduce the aerodynamic forces which would tend to deviate a projectile from its flight path towards a target, the investigation normally takes place by firing the projectile towards a target located in an evacuated range. As mentioned above, there is often a need to support the projectile in the barrel with a sabot. The form of sabot which has hitherto been used for these investigations has been substantially similar to the sabots employed for the normal launching of sub-calibre projectiles from ordnance in that they are constituted by radially splittable petalled structures which surround the projectile, and are strong enough to transfer the force of the propelling gas to the projectile and survive the high acceleration demands placed on them. When fired into an evacuated range the conventional aerodynamic discarding of the sabot from the projectile is achieved by the use of a short gas chamber through which the sabot and projectile pass and which provides sufficient aerodynamic drag to effect discarding of the sabot from the projectile. The individual sabot petals are then arrested before they reach the target by a guard containing a central passage through which the projectile passes on its flight towards the target. Frequent replacement of this guard is necessary.

A sabot has been proposed for use in light gas guns which comprises a monolithic load spreading rear plate in addition to a smaller spittable sabot structure as described above. A deflector is positioned to deflect the larger plate from the flight path of the projectile into a catcher butt, but allow the smaller projectile to pass undisturbed on its flight towards the target.

When small projectiles such as fragments are being launched however, the stripping of the sabot petals from the projectile causes an unpredictable disturbance to the flight path of the projectile. Typically when firing a 10 g cubic fragment over 10 m at a 150 mm square target at velocities in excess of 3500 m/s the success rate in hitting that target is in the order of 20%. As only a small number of firings can be carried out per day on a two stage light gas gun, due to the required pressurisation, evacuation of the range and the gun and the setting up of instrumentation, the cost of such a failure rate is high.

It is the object of the invention to provide a sabot for launching sub-calibre projectiles which is capable of accelerating a projectile to speeds in excess of 3500 m/s and yet releases the projectile with minimum perturbation to the projectile's flight path.

The inventors have recognised that if a relatively low aspect ratio projectile is being launched the force of the propelling gas may be transferred to the projectile by a simple pusher member and that the projectile need only be located with respect to the pusher member until the acceleration of the sabot has commenced. After this, the acceleration of the pusher member and the inertia of the projectile holds the projectile in place against the pusher member.

Thus according to a first aspect of the invention there is provided a sabot for a projectile comprising a rearwardly positioned projectile pusher member, and a forward support structure mountable on the pusher member to support a projectile characterised in that the support structure comprises frangible material having a compressive strength less than 600 $KN/m^2$ and greater than 30 $KN/m^2$ and which is collapsible by virtue of acceleration forces experienced during initial acceleration of the sabot to leave the projectile held in place against the pusher member by inertial forces for the remainder of the sabot's acceleration.

The support structure permits a projectile to be accurately located with respect to the pusher member but rapidly collapses due to its inherent weakness as the sabot is accelerated. By positioning the projectile in front of the pusher member separation of the sabot from the projectile in the direction of the sabot travel will occur due to the effect of the difference in aerodynamic drag experienced by the projectile and the larger pusher member. Both the support structure collapse and the separation of the projectile from the pusher member provide negligible effects on the projectile's flight path. The pusher member can then be deflected out of the path of the projectile by a suitably positioned deflector device as described above.

Using a sabot according to the invention the success rate of hitting an 150 mm square target with a 10 g cubic projectile at 10 m can be increased from the previous figure of 20% to 95% providing an enormous cost saving.

The support structure is preferably constituted by a void defining matrix, in order to facilitate its collapse.

The support structure preferably at least partially collapses when subjected to an acceleration in excess of $9\times10^4$ $m/s^2$. In this way the collapse of the support structure can be designed to occur soon after the initial acceleration of the sabot in a typical two stage light gas gun.

The support structure is preferably made of a foamed plastics material such as two part polyurethane foam. Such a material is cheaply available, easily workable and rapidly collapses and fragments into powdered form under acceleration.

Preferably at least 60% and more preferably at least 85% but less than 98% of the support structure's volume is constituted by voids, in order that sufficient projectile support can be provided and collapsed support structure material is not likely to effect the projectile's separation from the pusher member or the projectiles free flight.

The foam preferably has a density between 5 $Kg/m^3$ and 350 $Kg/m^3$.

The support structure preferably tapers towards its rear end.

This configuration encourages the support structure to fall away from the projectile being carried by the sabot as the support structure collapses.

The support structure preferably comprises a projectile surrounding sleeve connectable to a foremost surface of the pusher member, and may further comprise a cover also preferably made of a collapsible material for retaining a projectile in the sleeve under conditions of mechanical shock. These conditions of mechanical shock are found to occur in two stage light gas guns when firing is initiated. As the shock passes along the structure of the gun to the sabot faster than the gas pressure wave, the projectile may become dislodged from the support structure before the sabot is accelerated under the action of gas pressure if a retaining cover is not used.

The pusher member is preferably made of polycarbonate which can withstand the compressive loads resulting from the high accelerations concerned and has a high resistance to projectile setback.

According to a second aspect of the invention there is provided a sabot according to the first aspect of the invention in combination with a projectile.

In order that the unexpected effects associated with the near simultaneous impaction of a target with a plurality of projectiles can be investigated the sabot is preferably capable of launching a plurality of projectiles.

According to a third aspect of the invention there is provided a method of launching a projectile comprising supporting the projectile with a sabot according to the first aspect of the invention and accelerating the sabot and projectile using pressurised gas means. Preferable separation of the projectile from the pusher member is effected aerodynamically.

Figure 2:
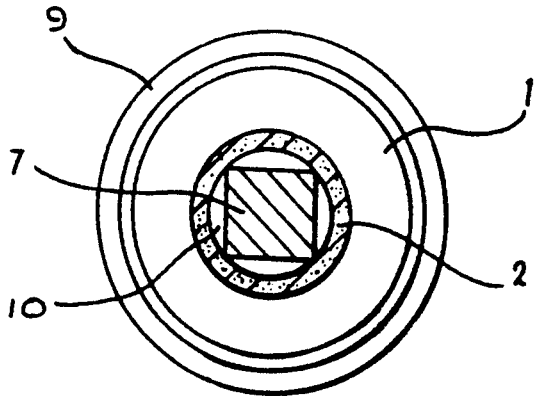
Figure 3:
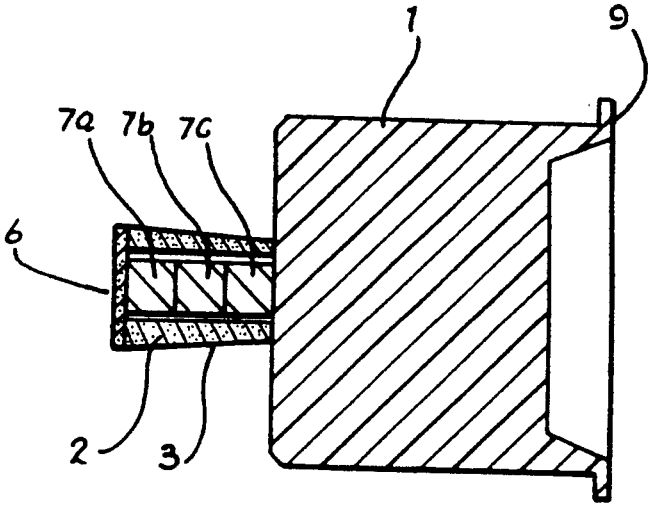
Figure 4:
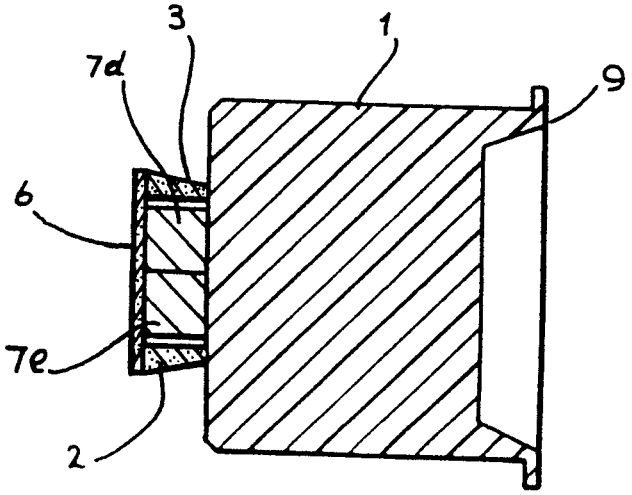
Figure 5:
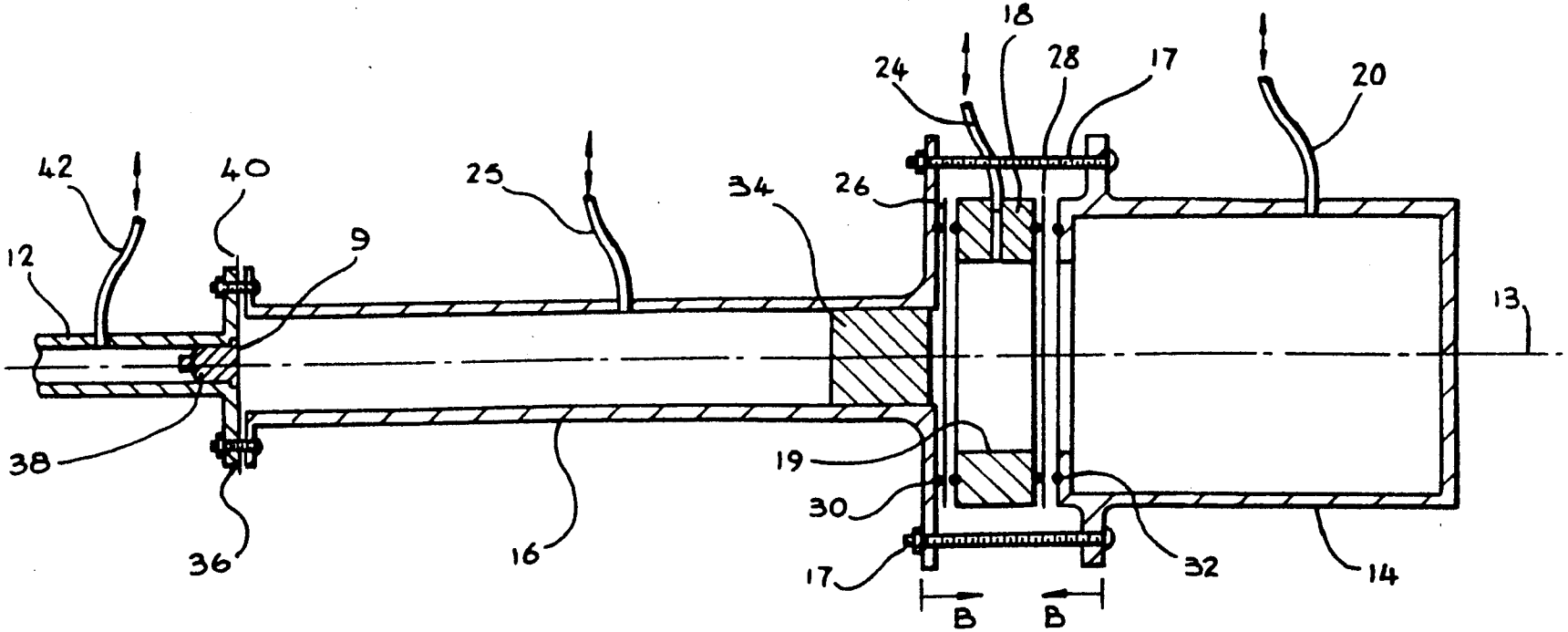

The invention will now be described by way of example only, with reference to the accompanying figures in which;

FIG. 1 shows a sabot according to the invention with an associated projectile ready for launch, in the launch barrel of a two stage light gas gun, FIG. 2 shows a cross section on the line AA of the sabot illustrated in FIG. 1 (barrel excluded), FIG. 3 shows a sabot according to the invention for launching three projectiles stacked on top of each other, FIG. 4 shows a sabot according to the invention for launching two projectiles in side by side relationship, and FIG. 5 is a longitudinal cross section of a light gas gun suitable for launching a projectile in accordance with the second aspect of the invention.

The sabot is axisymmetric about the axis 13 and shown in FIG. 1 mounted at one end of a launch barrel 12 of a two stage light gas gun. The arrow indicates the direction of travel of the sabot and of the wave of high pressure gas which travels down the gun to accelerate the sabot.

The sabot comprises a rearward pusher member 1 of polycarbonate, having a circumferential lip 9 at its rearward end for locating the sabot in the location shown. A hollow frusto-conical support structure 2 is glued to the foremost surface 8 of the pusher member. The outer surface 3 of the support structure tapers towards the rear end of the sabot. The support structure is made of two part cast polyurethane foam (Coolag Toucan System CSD 132 available from Coolag Ltd Charlestown, Glossop, Derbyshire SK13 8LE). The foam has a density of 30 $Kg/m^3$, a compressive strength of 172 $Kn/m^2$ and a 90% closed cell content by volume. A hole 10 in the support structure accommodates a projectile 7 to be launched, and is covered with a cover 6 of the same material as the rest of the support structure, glued in place. The cover 6 may alternatively be formed integrally with the frusto-conical part of the support structure, in which case the projectile would be located in the support structure before the support structure is glued to the foremost surface of the pusher member.

FIG. 3 shows in cross section a sabot according to the invention configured to accommodate a stack of three projectiles *7a*, *7b* and *7c*. The sabot shown in FIG. 4 is a further example of a sabot according to the invention which is configured to accommodate two projectiles *7d* and *7e* in side-by-side relationship. Like parts in FIGS. 1, 3 and 4 are designated by like numerals.

The foam for each support member is initially cast in a short length of plastic tube. The tube is then mounted in a lathe and the tube and part of the foam is machined off to leave a solid plug with a tapered outer surface 3. The support structure 2 is then removed from the lathe and drilled out to provide a central hole 10. The support structure is then ready to be glued to the foremost surface 8 of a pusher member 1. The pusher member is turned on a lathe to the axisymmetric shape shown in FIGS. 1 and 2 from a solid piece of polycarbonate. After one or more projectiles 7 have been inserted into the hole 10 in the support structure 2 a cover 6 made of cast foam is glued to a foremost surface 5 of the support structure 2.

The construction and operation of a two stage light gas gun will now be described with reference to FIG. 5. (Parts 14, 16, 18, 26 and 28 have been shown slightly separated in FIG. 5 for the sake of clarity. In use these parts would be clamped together by the yoke members 17 in the direction indicated by the arrows B).

The gun which is substantially axisymmetric about axis 13 comprises a driving chamber 14 connected to a compressor barrel 16 by yoke members 17. A diaphragm block 18 with a central passage 19 is insertable between the driving chamber and the compressor barrel with sufficient clearance on either side that a rupturable copper seal may be positioned between the diaphragm block and both the driving chamber and the compressor barrel. The driving chamber compressor barrel and diaphragm block are provided with valved connecting tubes 20, 25 and 24 respectively for effecting evacuation or pressurisation.

Rupturable copper seals 26 and 28 are positioned on either side of the diaphragm block 18 which are sealed to the diaphragm block, the compressor, barrel and the driving chamber by 'O' ring seals 30 and 32 held against the copper seals 26 and 28 by axial compression of the gas gun components for example by means of tensioning the yoke members 17.

A polythene piston 34 is slidably positioned in the compressor barrel adjacent its end nearest to the driving chamber. The opposite end of the compressor barrel is connected to a launch barrel 12 by means of bolted flanges 36. Evacuation of the launch barrel can be carried out via tube 42. A sabot according to the invention 38 is locatable at the flanged end of the launch barrel 12 with its circumferential lip 9 engaging an end face of the launch barrel. A rupturable plastics diaphragm 40 is positioned between the compressor barrel and the launch barrel.

The operating sequence of the gas gun described above is as follows:

a. the launch barrel, compressor barrel, driving chamber and diaphragm block are evacuated via the tubes 42, 25, 20 and 24 respectively, b. the compressor barrel is charged with helium to a pressure of 5 bar, via tube 25, c. the driving chamber 14 is charged with helium to a pressure of 250 bar via tube 20 while the diaphragm block 18 is charged with helium and maintained at half of the pressure in the driving chamber via tube 24, d. the pressure in the diaphragm block 18 is reduced to a level at which the pressure differential experienced by the copper seal 28 ruptures it, e. copper seal 26 ruptures soon after and the polythene piston 36 is driven down the compressor barrel 16 by the force of the compressed helium expanding out of the driving chamber. Helium in front of the piston 34 is compressed and a resulting pressure wave ruptures the plastics diaphragm 40 and forces the sabot away from the end of the launch barrel 12 breaking off the lip 9 in the process and accelerates the sabot and projectile down the barrel.

h. As the sabot accelerates the foam support structure 2 collapses and falls away from the projectile thereafter the inertia of the projectile 7 holds the projectile against the pusher member 1, i. when the pusher member and projectile pass through an air chamber with rupturable end diaphragms (not shown), differential air resistance between the pusher member and the projectile will retard the pusher member allowing the projectile to progress alone.

The sabot discard steps h and i occur with negligible effect on the flight path of the projectile. Acceleration of the sabot and projectile may alternatively be effected by using an explosive charge.

We claim:

1. A sabot for a projectile comprising a rearwardly positioned projectile pusher member (1), and a forward support structure (2) mountable on the pusher member to support a projectile characterised in that the support structure (2) comprises frangible material having a compressive strength less than 600 $KN/m^2$ and greater than 30 $KN/m^2$ and which is collapsible by virtue of acceleration forces experienced during initial acceleration of the sabot to leave the projectile held in place against the pusher member by inertial forces for the remainder of the sabot's acceleration.

2. A sabot as claimed in claim 1 characterised in that the support structure (2) is voided.

3. A sabot as claimed in claim 1 characterised in that the support structure (2) at least partially collapses when subjected to an acceleration above $9\times10^4$ $m/s^2$.

4. A sabot as claimed in claim 1 characterised in that the support structure is made of a foamed material.

5. A sabot as claimed in claim 4 characterised in that the foamed material is a foamed plastic.

6. A sabot as claimed in claim 2 characterised in that between 60% and 98% of the support structure's volume is constituted by voids.

7. A sabot as claimed in claim 1 characterised in that the support structure has a density less than 350 $Kg/m^3$ and greater than 5 $Kg/m^3$.

8. A sabot as claimed in claim 1 characterised in that the support structure tapers towards its rear end.

9. A sabot as claimed in claim 1 characterised in that the support structure comprises a projectile-surrounding sleeve.

10. A sabot as claimed in claim 9 further comprising a cover (6) positionable to retain a projectile within the sleeve prior to sleeve collapse.

11. A sabot as claimed in claim 10 characterised in that the cover (6) is made of a voided material.

12. A sabot as claimed in claim 1 characterised in that the pusher member (1) is made of polycarbonate.

13. A sabot as claimed in claim 1 in combination with and accomodating a projectile (7).

14. A sabot in combination with a projectile as claimed in claim 13 characterised in that the projectile is cuboidal.

15. A sabot as claimed in claim 1 in combination with and accommodating a plurality of projectiles (*7a*, *7b*, *7c*, *7d*, *7e*).

16. A method of launching a projectile comprising supporting the projectile with a sabot as claimed in claim 1 and accelerating the sabot and projectile using pressurised gas means.

17. A method of launching a projectile as claimed in claim 16 further comprising the step of separating the projectile from the pusher member by means of aerodynamic drag differential.

* * * * *